US005456794A

United States Patent [19]

Barrett

[11] Patent Number: 5,456,794

[45] Date of Patent: Oct. 10, 1995

[54] CARPET STRIPPING DEVICE

[76] Inventor: Glenn Barrett, 12750 SW. 15th Manor, Fort Lauderdale, Fla. 33325

[21] Appl. No.: 324,775

[22] Filed: Oct. 17, 1994

[51] Int. Cl.[6] ..... B32B 35/00

[52] U.S. Cl. ..... 156/584; 156/344; 254/200; 254/202; 254/227; 254/262; 294/8.6; 294/103.1

[58] Field of Search ..... 156/344, 584; 254/199, 200, 202, 208, 209, 210, 211, 213, 227, 242, 262; 294/8.6, 103.1, 104

[56] References Cited

U.S. PATENT DOCUMENTS

| | | | |
|---|---|---|---|
| 4,215,849 | 8/1980 | Charland | 254/227 X |
| 4,332,371 | 6/1982 | Bell et al. | 254/203 |
| 4,560,146 | 12/1985 | Thomas et al. | 156/344 X |
| 5,348,608 | 9/1994 | Glenn et al. | 156/344 |

FOREIGN PATENT DOCUMENTS

| | | | |
|---|---|---|---|
| 417352 | 3/1991 | European Pat. Off. | 294/8.6 |
| 1291478 | 3/1969 | Germany | 294/8.6 |

*Primary Examiner*—Mark A. Osele

*Attorney, Agent, or Firm*—Malin, Haley, DiMaggio & Crosby

[57] ABSTRACT

A carpet stripping device for stripping adhesively secured carpeting from an underlying subfloor. The device incorporates a base supporting a winch drum to which power is transmitted through a gearbox and mechanical clutch by a variable speed electric motor. The base incorporates a plurality of anchoring teeth fixed to the base's undersurface, and a wheeled supporting frame including a plurality of pivotally linked members selectively positionable between an elevated position whereby the assembly is movable, to an anchored position whereby the wheels are raised, lowering the base, such that the anchoring teeth penetrate underlying carpeting thereby securing the winch. A gripping jaw assembly having gripping teeth fixed to both upper and lower jaw elements is secured to a portion of carpet located remote from the anchored assembly, and connected by a winch cable. Activating the driving motor and engaging the clutch allows a user to easily strip carpeting by pulling the gripping jaw toward the anchored winch. A skid plate connected to the underside of the lower jaw element ensures that the jaw slides smoothly over any obstacles.

6 Claims, 5 Drawing Sheets

CARPET STRIPPING DEVICE

BACKGROUND OF THE INVENTION

1. Field of the Invention

The instant invention relates to floor covering stripping devices, and more particularly to devices for stripping floor coverings that have been adhesively secured to an underlying subfloor.

2. Description of the Prior Art

Many types of floor coverings such as carpet and linoleum are secured to an underlying subfloor by adhesives. In commercial applications it is typical to coat vast floor areas with special adhesives after which time large sections of floor covering, such as carpet, are installed thereby securing the floor covering to the underlying subfloor. Securing carpet in this manner has proven highly effective and, hence, has gained wide acceptance in recent years. Carpeting in high traffic areas, however, can quickly wear thus requiring periodic replacement; but carpeting installed using adhesive has proven difficult to remove. As a result, the prior art reveals a number of devices designed to remove floor covering, especially carpet, that is secured to a subfloor by adhesive.

One such device is revealed by U.S. Pat. No. 4,560,146, issued to Thomas et al. Thomas teaches an assembly designed to strip carpet or like floor covering from the surface of a floor to which it is directly adhered wherein a gripping jaw is affixed to a carpet portion to be stripped and interconnected to a driving assembly by cable.

Thomas contemplates anchoring the driving assembly by the use of an anchor means comprising a base having teeth extending outwardly from the base undersurface into penetrating relation with an anchoring carpet portion. Thomas utilizes a pivotally movable anchor base attached to a support frame and selectively positionable between an anchoring position defined by an outwardly extending disposition of said anchoring base relative to the support frame, and a stored position of said anchoring base by virtue of a pivot connection between the anchoring base and support frame. The anchoring means of Thomas, however, has several inherent disadvantages: firstly, since the anchoring means pivots to an outwardly extending anchoring position, the support frame must be located some distance from walls and other obstructions; secondly, in its stored position, the anchoring means is disposed such that the teeth are dangerously exposed.

U.S. Pat. No. 4,533,118, also issued to Thomas et al., discloses a STRIPPER ASSEMBLY FOR REMOVING CARPET wherein a gripping jaw, incorporating a grasping means comprising a plurality of teeth and positioning blocks disposed and configured to force a portion of carpet into abutting engagement with the teeth so as to be penetrated thereby, is affixed to a carpet portion to be stripped and interconnected to an anchored driving assembly which causes a pulling force on the gripping jaw for stripping the carpet.

The gripping jaw disclosed by Thomas, however, incorporates several disadvantages. First, since the gripping jaw merely has positioning blocks mounted on one of the jaw members, only the lower member having teeth applies force to the secured carpet resulting in uneven force distribution. Second, as best depicted in FIGS. 5 and 7 of the '118 patent, a number of bolts, designated 61, protrude from the undersurface of the lower jaw element. This arrangement is potentially very dangerous should a bolt, while the gripping jaw is being dragged across the floor, catch on a floor mounted electrical outlet causing pulse of electricity to travel up the connecting cable, possibly electrocuting the operator.

U.S. Pat. No. 4,332,371 issued to Bell, discloses a CARPET REMOVING APPARATUS AND METHOD for removing carpet which may have been adhesively bonded to the floor of a building. Bell's method, however, requires drilling a number of holes into the floor for providing anchoring points for a power winch and anchoring pulleys. This anchoring method is not desirable for reasons that include damage or disfigurement of the floor and the need for specialized drilling equipment.

Thus, there exists a need for a carpet stripping device incorporating an improved means for anchoring the device that is safe, simple, and does not require that holes be drilled in the subfloor, and an improved means for gripping the carpet section to be stripped that distributes forces evenly and glides smoothly over any surface.

SUMMARY OF THE INVENTION

The present invention is directed toward an improved carpet stripping device that overcomes the aforementioned limitations and disadvantages present in the prior art. The instant invention contemplates a device that is wheeled into position on an expanse of carpet that is adhered to an underlying subfloor, anchored in place, connected to a remote portion of carpet by a winch cable terminating in a gripping jaw, and energized such that the gripping jaw is drawn toward the anchored device thereby stripping the attached carpet.

The device generally comprises a base supporting a winch which includes a winch drum to which power is transmitted through a clutch by a driving means such as an electric motor. The base is connected to a frame including a plurality of pivotally linked members selectively positionable between a "standing" position whereby the base is elevated and supported by wheeled members for moving the device to a particular location, and a "sitting" position whereby the wheeled members are pivoted out of a supporting position such that the base is lowered to the underlying surface. The base bottom incorporates a plurality of angled, downwardly projecting gripping members such that when the base is lowered to a sitting position on carpet, the weight of the device causes the gripping members to penetrate the underlying carpet thereby securely anchoring the base.

Once anchored, a winch cable terminating in a gripping means is extended and secured to a remote portion of carpet. The gripping means generally comprises a jaw-like assembly having pivotally connected upper and lower jaw elements selectively positionable between an open and a closed position. Grasping teeth are mounted on the interior surfaces of the cooperating jaw elements such that when a portion of carpet is inserted between the elements and said elements are positioned to a closed configuration, each element exerts a grasping force on opposing sides of the carpet resulting in even force distribution. In addition, the undersurface of the lower jaw element incorporates a structure which positions the aforementioned bolts above the floor surface thereby allowing the gripping jaw to avoid floor receptacles and slide smoothly across the carpet surface during the stripping process.

In accordance with the instant invention, it is an object thereof to provide an improved apparatus for stripping adhesively secured floor covering quickly and efficiently.

It is a further object of the instant invention to provide an improved device for stripping adhesively secured floor covering, such as carpet, wherein the device may be anchored by a portion of carpet substantially adjacent to a wall.

Still another object of the present invention is to provide an improved means of gripping a portion of carpet remote from an anchored winch base such that forces are distributed and dissipated evenly over the gripping member.

A further object of the instant invention is to provide an improved means of gripping a portion of carpet remote from the anchored winch base wherein the gripping member slides smoothly over the intervening surface.

Yet another object of the instant invention is to provide a carpet stripping winch that is geared and may be selectively engaged by a user through a clutch mechanism.

In accordance with these and other objects which will become apparent hereinafter, the instant invention will now be described with particular reference to the accompanying drawings.

DESCRIPTION OF THE PREFERRED EMBODIMENTS

Figure 1:
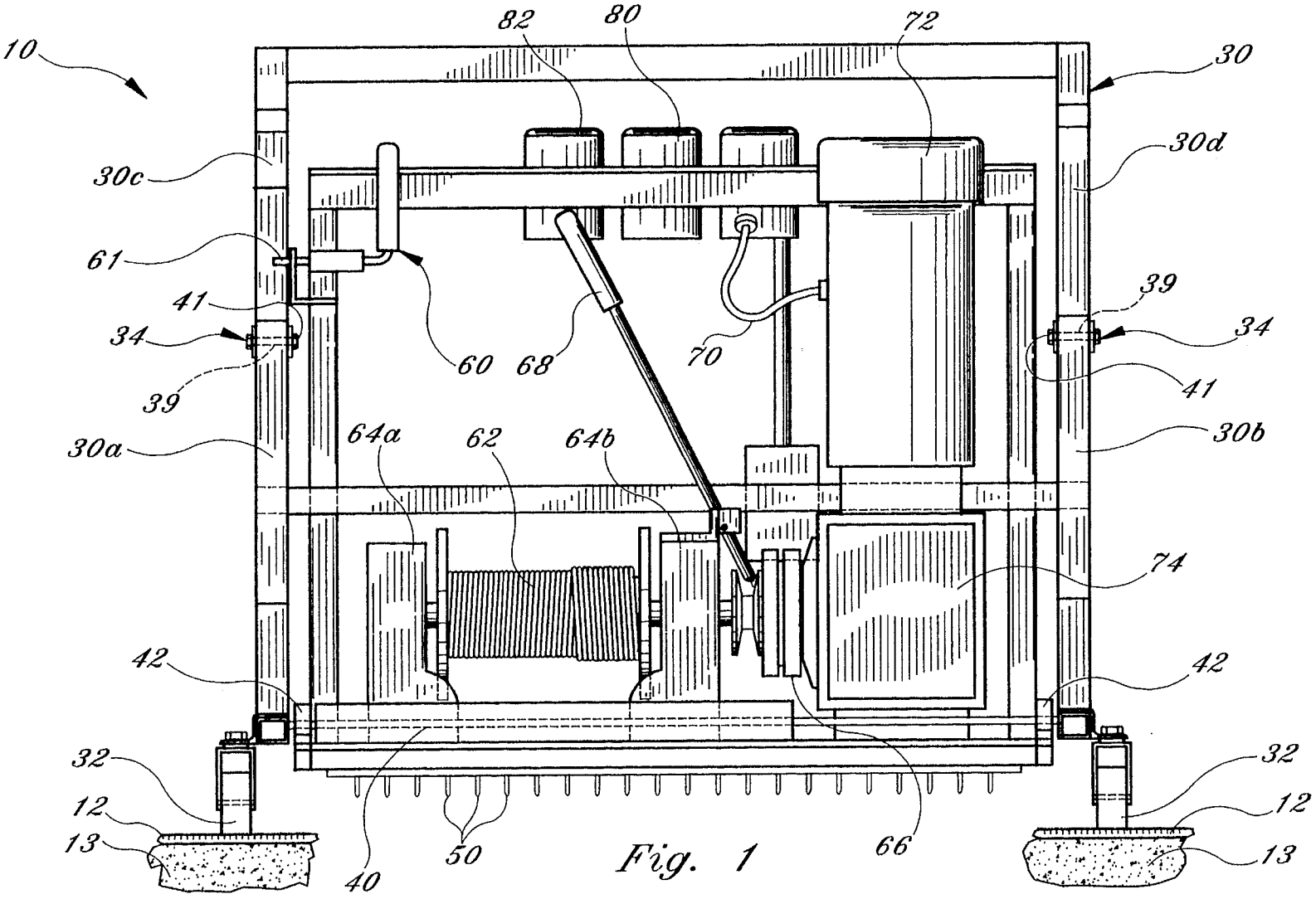
FIG. 1 is a front elevational view of the winch platform of the instant invention.

Turning now to FIGS. 1–6 there is depicted a preferred embodiment of the instant invention. The invention includes a winch platform, generally designated 10, connected by cable 63 to a carpet gripping member 90 for stripping adhesively secured carpet 12 from an underlying subfloor 13 by attaching the gripping member to a remote portion of carpet 91, anchoring the winch platform, and pulling the gripping member toward the platform with a winch, thereby peeling back the carpet.

The invention includes a winch platform or frame, generally designated as 10, having a substantially rectangular support base 20 pivotally connected to a wheeled frame 30. Frame 30 includes a plurality of articulated cooperating vertical support members 30*a*, 30*b*, 30*c*, 30*d* each pivotally connected proximate the platform perimeter. Each support member has a lower portion terminating in a wheel 32 and an upper portion incorporating a pivot connection 34 for reasons that will soon become apparent.

Support members 30 are configured in pairs. A front pair of support members 30*a* and 30*b* are pivotally connected to base 20 proximate the base front end; and a rear pair of support members 30*c* and 30*d* are pivotally connected to base 20 proximate the base rear end. Accordingly, each base side has one front support member and one rear support member. Each front and rear support member pair may utilize an interconnecting axle 40 connected to base 20 by a pair of pillow block mounted ball bearings 42 incorporating set screws for engaging axle 40 received therein. Ball bearings 42 may be fixed proximate the base 40 perimeter by conventional fasteners. Any other suitable means for allowing frame 10 to be portable (such as rolling) and which allows base 20 to be lowered into engagement with a floor surface is contemplated to be within the scope of this invention.

Figure 2:
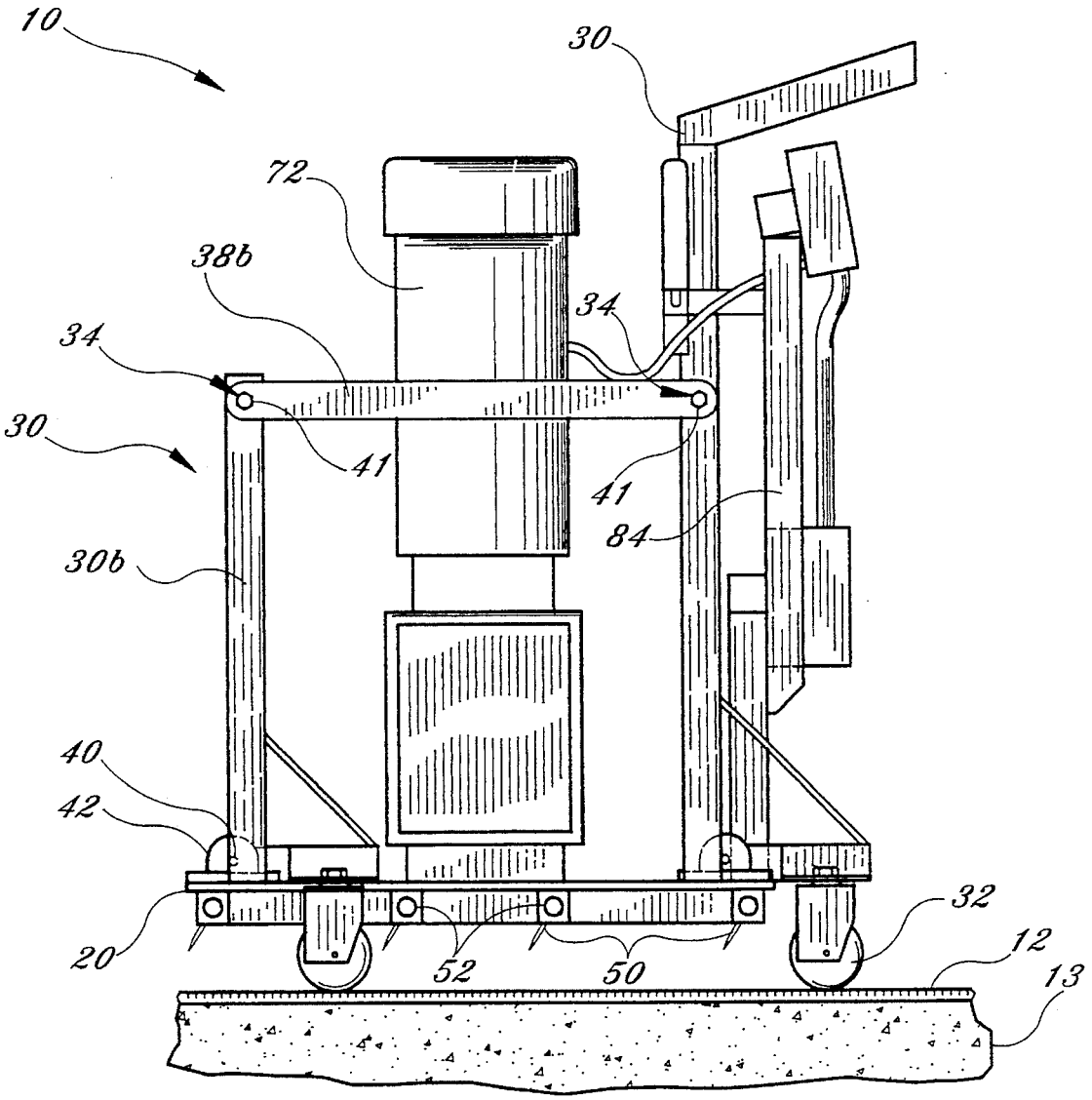
FIG. 2 is a left side elevational view of the winch platform of the instant invention in a standing position.
Figure 3:
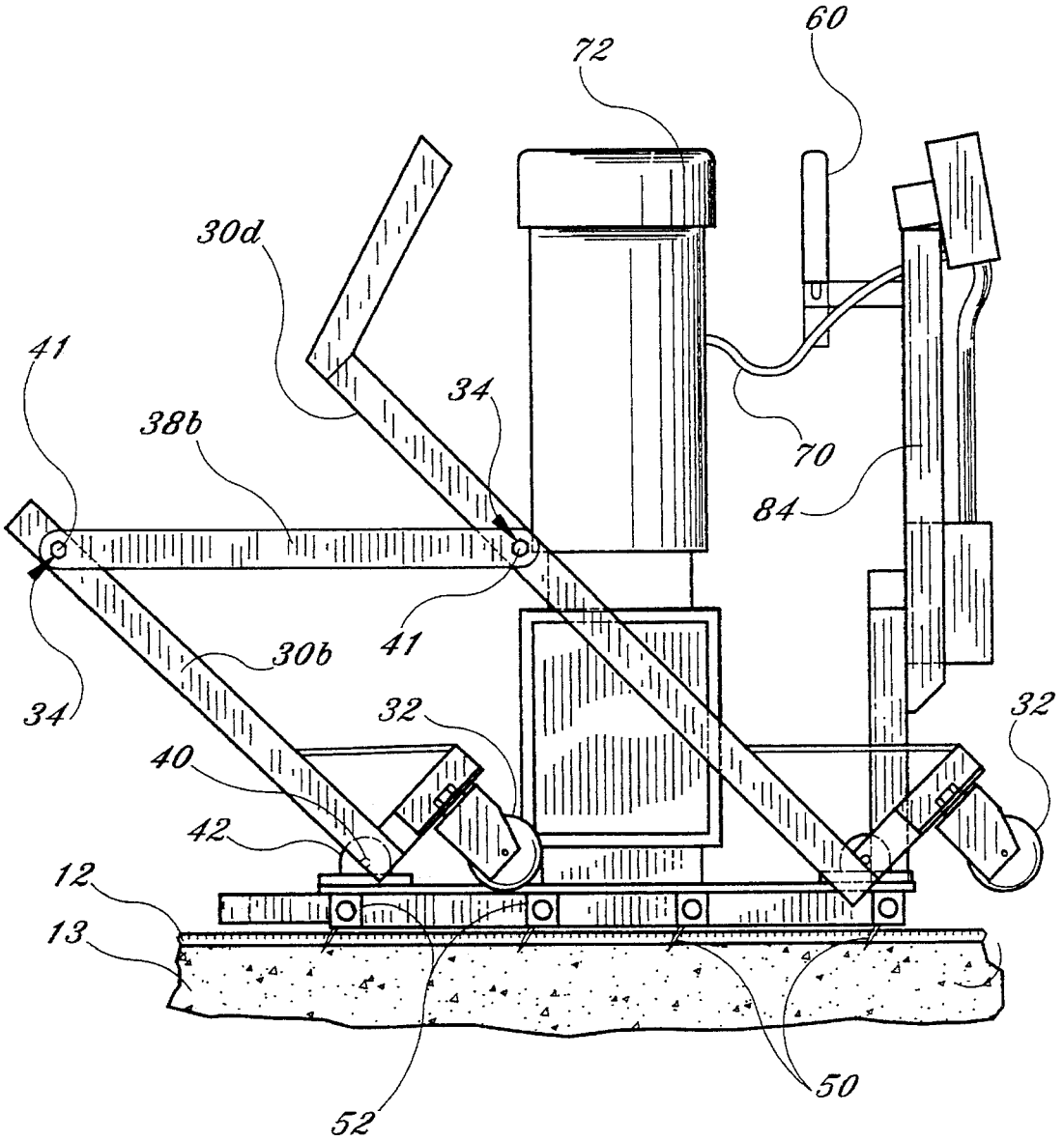
FIG. 3 is a left side elevational view of the winch platform of the instant invention in an anchored position.
Figure 6:
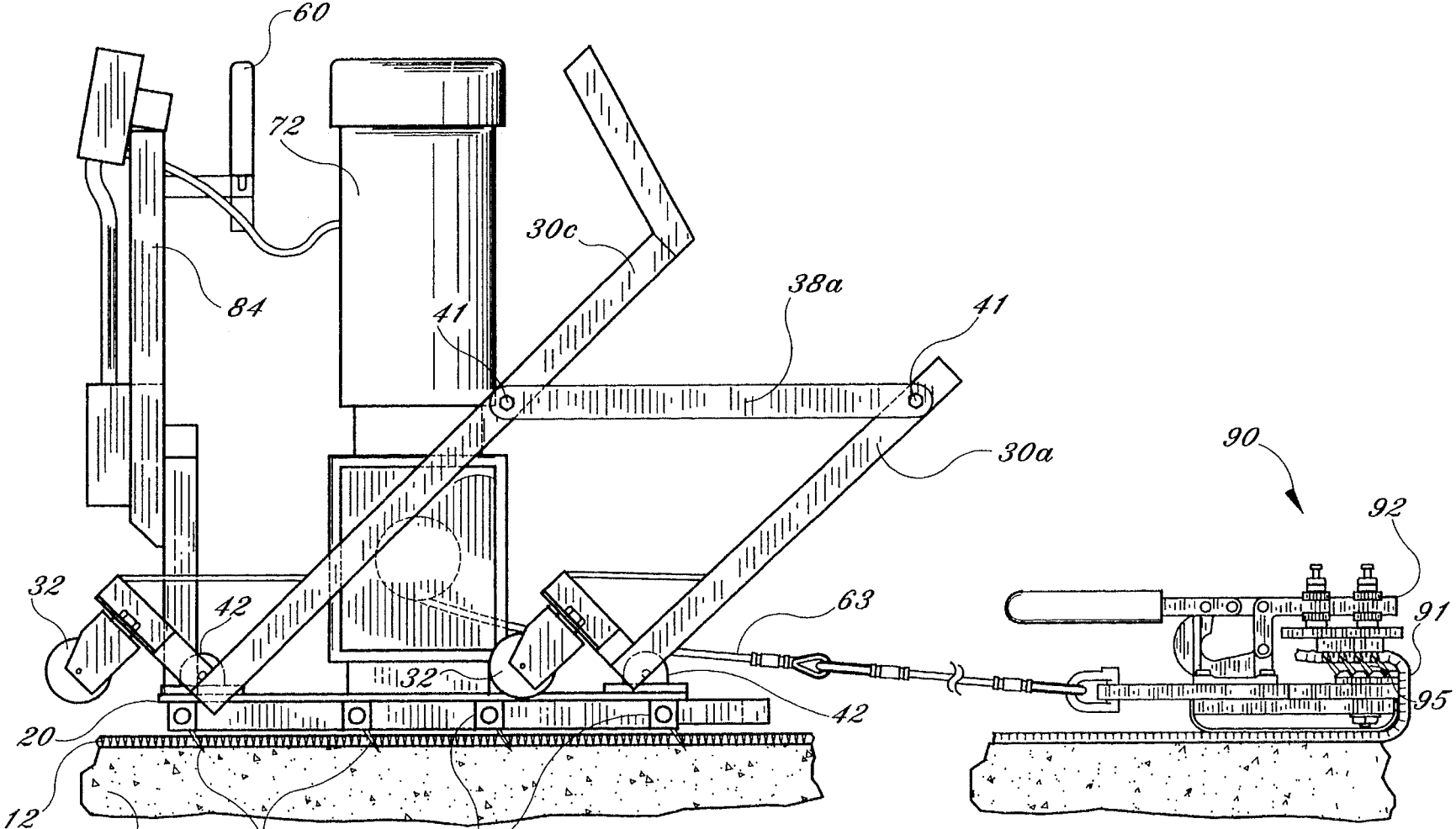
FIG. 6 is a side elevational view of the winch platform of the instant invention attached to the carpet gripping jaw.

Turning now to FIGS. 1 and 2, frame 30 further incorporates a pair of elongated linkage members 38*a* and 38*b* having apertures 39 at opposing ends for engaging vertical frame support members 30*a–d*. Each linkage member aperture 39 is aligned with apertures existing on front and rear support members for receiving a connecting pin 41 therethrough for forming a pivot connection, generally designated 34. As a result, linkage members 38*a* and 38*b* allow frame 30 to pivot about axles 40 between a "standing" position wherein base 20 is elevated with respect to the supporting floor surface, as depicted in FIGS. 1 and 2, and "sitting" or anchored position wherein vertical support members 30 pivot forward thereby retracting wheels 32 such that base 20 rests on the underlying floor 12, as depicted in FIGS. 3 and 6.

In its standing position, wheels 32 support the invention thereby allowing a user to selectively position the invention by simply rolling it to a desired location. In its sitting position, support members 30*a*, 30*b*, 30*c*, and 30*d* are pivoted forward, in a cooperating manner, causing wheels 32 to retract thereby lowering base 20 to the underlying floor.

Anchoring of base 20 is accomplished using the weight of the winch platform and a plurality of forward angled, downwardly projecting anchoring members 50 fixed to the undersurface of base 20 as best depicted in FIGS. 1–3 and 6. In the preferred embodiment anchoring members 50 are aligned in rows and secured by, for example, bar stock members 52. Members 52 may be fixed to the undersurface or base 20 in any suitable manner. Thus, when base 20 is lowered to a sitting position, the weight of the base assembly causes the projecting anchoring members to penetrate the underlying carpet 12 thereby anchoring frame 10 securely in place relative to the floor. Lowering base 20 to a sitting position enhances stability and reduces the chance of tipping.

The effectiveness of the aforementioned anchoring means is enhanced by the base being projected slightly forward while being lowered thereby ensuring that the forward angled, downwardly projecting, anchoring members sufficiently penetrate the underlying carpet. Likewise, freeing the instant invention from its anchored position is also enhanced by the base being projected slightly rearwardly while being raised to its standing position, thereby facilitating the removal of the anchoring members.

A locking mechanism 60, which includes a locking pin 61 biased into the locked position shown in FIG. 1 by a spring or other biasing member (not shown), may be selectively engaged by a user to secure the frame assembly in the "standing" position. Pin 61 prevents members 30 *a–d* from being collapsed into the position shown in FIG. 3 by preventing member 30*d* from pivoting forward unless pin 61 is moved by pulling handle 60 to the right in FIG. 1. Upon disengaging locking mechanism 60 the frame assembly is free to pivot.

The instant invention further incorporates a winch 62, mounted on a pair of flanges 64*a* and 64*b*. A mechanical clutch 66 functions to selectively transmit driving power from motor 72 to winch 62. Clutch 66 has a clutch lever 68 for allowing a user to selectively engage the clutch. Power is provided through a power cord 70 to electric motor 72 that generates rotational power which is transmitted through a gearbox 74 for increasing-available torque and RPM reduction. Gearbox 74 has an output shaft for transmitting driving power to the winch via clutch 66. The invention contemplates motor control elements including an ON/OFF power switch 80, and a variable speed controller 82. Speed controller 82 allows a user to vary the winch speed for maximizing the stripping process. Power switch 80 and controller 82 are mounted on a vertically extending control frame 84.

Figure 4:
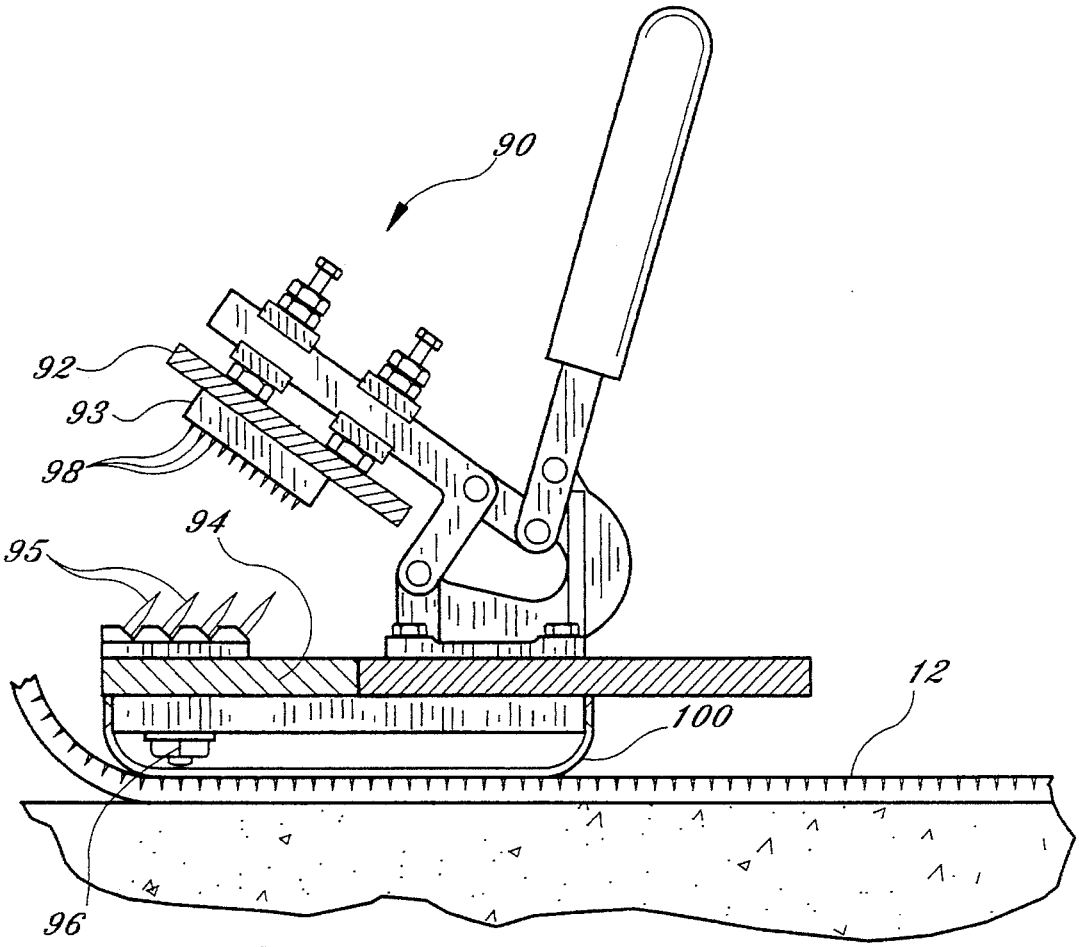
FIG. 4 is a side elevational view of the carpet gripping jaw of the instant invention in an open position for receiving a portion of carpet.
Figure 5:
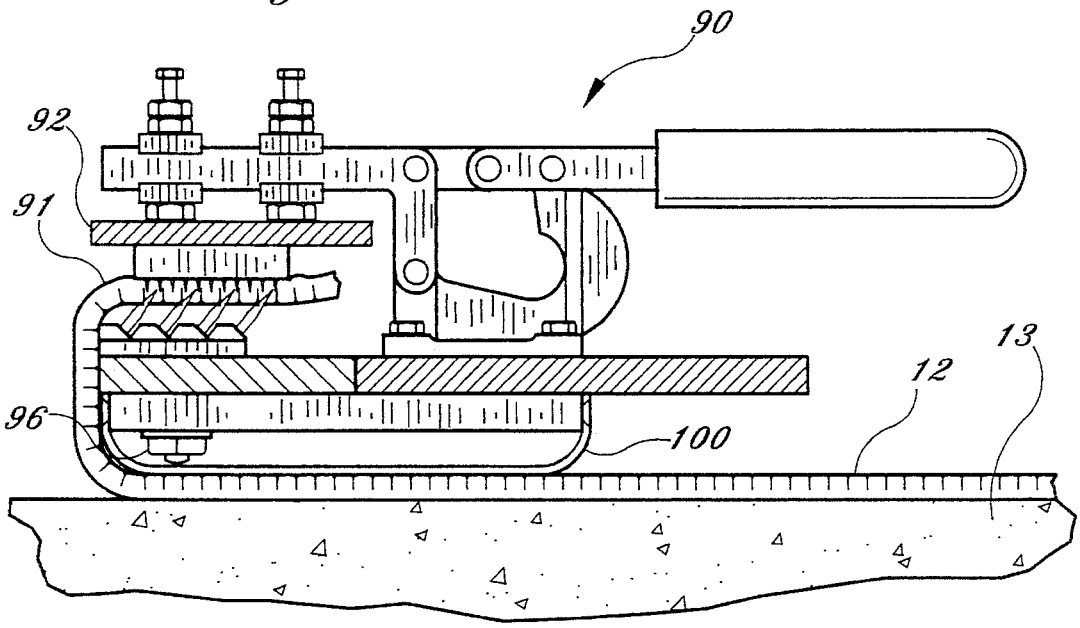
FIG. 5 is a side elevational view of the carpet gripping jaw of the instant invention in a closed position securing a portion of carpet.

A winch cable 63 interconnects winch 62 to a jaw-like carpet gripping device, generally designated 90 in FIGS. 4–6. Carpet gripping device 90 includes pivotally connected, upper and lower, jaw elements 92 and 94 respectively. Jaw elements 92 and 94 are selectively positionable between an open position as depicted in FIG. 4, and a closed position as depicted in FIG. 5. Grasping teeth are mounted on the interior surfaces of the cooperating jaw elements such that when a portion of carpet 91 is inserted between the elements and said elements are positioned to a closed configuration, each element exerts a grasping force on opposing sides of the carpet.

In the preferred embodiment, a plurality of angled, vertically projecting grasping teeth 95 are fixed to lower jaw element 94 by bolt fasteners 96. Grasping teeth 95 are configured in evenly spaced rows resulting in grasping teeth spacing of between 1 and 3 inches. Upper jaw element 92 incorporates a plurality of plates 93 fixed to the undersurface of the upper jaw element 92. Each plate 93 incorporates a plurality of relatively small downward projecting "cotton teeth" 98. Each plate 93 has a dimension that is larger than the space separating the grasping teeth of the lower jaw element such that each cotton teeth plate bridges the gap existing between the lower element grasping teeth 95 when the jaw like gripping device is in its closed position. As a result, when a portion of carpet in inserted between the upper an lower jaw elements, and the gripping jaw is brought to its closed position, the upward projecting teeth of the lower jaw element penetrate the inserted carpet from one side while the downward projecting cotton teeth at least partially penetrate the carpet from the opposite side thereby securely holding the carpet between the closed jaw elements.

An additional feature of the instant invention allows jaw-like carpet gripping device 90 to slide smoothly over the floor surface while being drawn toward the winch during the carpet stripping process. In the preferred embodiment, the undersurface of the lower jaw element is fitted with a structure 100 for providing a smooth sliding surface and covering the projecting fasteners 96 which secure the lower jaw teeth 95. Structure 100 thereby prevents the carpet gripping jaw from snagging on floor hardware, such as electrical outlets, while sliding across the floor.

To use the instant invention, a user rolls the winch platform to a desired location, anchors the winch platform to underlying carpet by lowering the platform, such that anchoring teeth 50 on the undersurface of the platform penetrate the underlying carpet thereby anchoring the assembly, connecting winch cable 63 to jaw-like carpet gripping device 90 that is secured to a remote portion of carpet, and exerting a pulling force on the carpet gripping member by activating the winch which causes the gripping jaw to be drawn toward the winch thereby stripping, or peeling back the carpet.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A device for removing adhesively secured carpet from an underlying subfloor including:

means for gripping a portion of carpet;

means for pulling said gripping means, mounted on a base and connected to said gripping means by a cable;

said base having upper and lower surfaces, and supported by a frame having a plurality of downwardly extending members terminating at wheels;

means for anchoring said pulling means relative to said subfloor, said means for anchoring comprising a plurality of downward projecting teeth fixed to said base undersurface, and a means for retracting said wheels thereby lowering said base such that said teeth penetrate underlying carpet anchoring said base mounted means for pulling;

said means for pulling capable of exerting tension on said cable thereby drawing said gripping means such that said carpet is stripped from said subfloor.

2. A device for removing adhesively secured carpet from an underlying subfloor according to claim 1, wherein said wheel retracting means comprises a plurality of hinged frame members whereby said frame members cooperate in pivotally retracting said wheels.

3. A device for removing adhesively secured carpet from an underlying subfloor according to claim 1, wherein said gripping means comprises a jaw assembly having upper and lower jaw elements for securing a portion of carpet therebetween.

4. A device for removing adhesively secured carpet from an underlying subfloor according to claim 3, wherein a plurality of upward projecting gripping teeth are fixed, in spaced formation, to said lower jaw element, and a plurality of plates, each plate having a plurality of downward projecting teeth, are fixed to said upper jaw element, such that a portion of carpet inserted therebetween is penetrated from opposing sides by said upper and lower teeth thereby securely gripping said carpet portion.

5. A device for removing adhesively secured carpet from an underlying subfloor according to claim 3, wherein, said gripping means lower jaw element incorporates a structure forming a smooth surface for allowing said jaw assembly to slide across a floor surface without snagging.

6. A device for removing adhesively secured carpet from an underlying subfloor including:

a jaw assembly having upper and lower jaw elements, said jaw elements each having projecting teeth for securing a portion of carpet inserted therein;

a winch mounted on a base and connected to said carpet jaw assembly by a winch cable;

said base having upper and lower surfaces, and supported by a frame having a plurality of, downwardly extending members terminating at wheels, such that said base lower surface is elevated with respect to an underlying carpeted surface;

means for anchoring said winch relative to said subfloor, said means for anchoring comprising a plurality of forward angled, downwardly projecting, teeth fixed to said base lower surface, and a means for retracting said wheels thereby lowering said base whereby said lower surface teeth penetrate underlying carpet thereby anchoring said base mounted winch;

means for transmitting power to said winch, said power transmitting means including an electric motor, a reducing gear assembly for increasing available torque, and a mechanical clutch, for selectively driving said winch thereby drawing said jaw assembly and said secured portion of carpet toward said winch such that said secured carpet is stripped from said subfloor.

* * * * *